US009405228B2

(12) United States Patent
Lee et al.

(10) Patent No.: US 9,405,228 B2
(45) Date of Patent: Aug. 2, 2016

(54) DEVELOPER DISCHARGING DEVICE FOR IMAGE FORMING APPARATUS

(71) Applicant: Sindoh Co., Ltd., Seoul (KR)

(72) Inventors: Byoung Bag Lee, Seoul (KR); Goo Chul Jung, Seoul (KR); Jin Sam Park, Seoul (KR)

(73) Assignee: SINDOH CO., LTD., Seoul (KR)

( * ) Notice: Subject to any disclaimer, the term of this patent is extended or adjusted under 35 U.S.C. 154(b) by 0 days.

(21) Appl. No.: 14/723,873

(22) Filed: May 28, 2015

(65) Prior Publication Data

US 2016/0147179 A1 May 26, 2016

(30) Foreign Application Priority Data

Nov. 24, 2014 (KR) ..... 10-2014-0164345

(51) Int. Cl.
*G03G 15/08* (2006.01)

(52) U.S. Cl.
CPC ..... *G03G 15/0891* (2013.01)

(58) Field of Classification Search
None
See application file for complete search history.

(56) References Cited

U.S. PATENT DOCUMENTS

2008/0260430 A1* 10/2008 Sakamoto ..... G03G 15/0822 399/254
2008/0317508 A1* 12/2008 Terai ..... G03G 15/0815 399/254
2010/0040391 A1* 2/2010 Uno ..... G03G 21/105 399/53
2011/0311279 A1* 12/2011 Okazaki ..... G03G 15/0887 399/254
2015/0301477 A1* 10/2015 Akedo ..... G03G 15/0893 399/254
2016/0062304 A1* 3/2016 Lee ..... G03G 15/0886 399/359
2016/0085178 A1* 3/2016 Kawasumi ..... G03G 15/0881 399/106

FOREIGN PATENT DOCUMENTS

JP 2011191676 A * 9/2011

OTHER PUBLICATIONS

English machine translation of JP2011191676A;"Toner Discharge Mechanism, Toner Cartridge and Image Forming Apparatus Using the Toner Cartridge"; by Hayashi,Shigeki; & Nagai,Takafumi; published Mar. 16, 2010.*

* cited by examiner

*Primary Examiner* — David Gray
*Assistant Examiner* — Geoffrey Evans
(74) *Attorney, Agent, or Firm* — Nixon & Vanderhye P.C.

(57) ABSTRACT

Disclosed is a developer discharging device for an image forming apparatus, which is installed in a developing unit configured to transfer and discharge a developer collected from a drum unit or a newly introduced developer, such that the developer is discharged to a developer collecting unit, including a first discharging part configured to extend from an end of a transferring screw installed in the developing unit, and a second discharging part disposed above the first discharging part in parallel with the first discharging part, wherein the developer discharged from the second discharging part falls into the developer collecting unit. Therefore, it is possible to prevent the developer from being sharply discharged, and thus to constantly maintain an amount of the developer.

3 Claims, 5 Drawing Sheets

DEVELOPER DISCHARGING DEVICE FOR IMAGE FORMING APPARATUS

CROSS-REFERENCE TO RELATED APPLICATION

This application claims priority to and the benefit of Korean Patent Application No. 10-2014-0164345, filed on Nov. 24, 2014, the disclosure of which is incorporated herein by reference in its entirety.

BACKGROUND

1. Field of the Invention

The present invention relates to a developer discharging device for an image forming apparatus, and more particularly, to developer discharging device for an image forming apparatus, which is capable of preventing a developer from being sharply discharged, and thus constantly maintaining an amount of the developer.

2. Discussion of Related Art

An image forming apparatus, such as a copy machine, a printer and a multifunction printer, is divided into an ink-jet type, an electro-photographic type and a thermal printing type. Here, in the electro-photographic type image forming apparatus, an image is formed on a print medium through a series of charging, exposing, developing, transferring and fixing processes.

A conventional electro-photographic type image forming apparatus includes a cartridge assembly in which a drum unit having a photoconductive drum, a charging roller and a transfer roller, and a developing unit configured to accommodate a developer therein and having a developing roller and a supplying roller are integrally formed.

Here, the cartridge assembly accommodates the developer including toner and carrier, and the developer should be refilled or replaced due to a consumption of the toner according to a printing operation.

In a conventional refilling/replacing method of the developer, a waste developer, i.e., a waste toner and a waste carrier were collected and discharged at the same time, and then a new developer was refilled. However, in the conventional method, an amount of the developer sent to a dump was large, and a separate waste developer receiving part was required.

An image forming apparatus which collects and reuses toner in consideration of a conventional developer consumption is disclosed in Japanese Patent Publication No. 1993-66659 (related document 1). The related document 1 discloses a process cartridge in which a waste toner tank is integrally installed at the photoconductive drum, and a discharging mechanism for collecting the waste toner of the waste toner tank into the developing machine is installed.

Also, an image forming apparatus which collects and reuses the toner and controls a carrier supply is disclosed in Japanese Patent Publication No. 2001-194908 (related document 2).

Here, in the conventional image forming apparatus including the above-described documents, a method of discharging the developer of the developing unit to the waste toner tank may be classified into a reverse pitch screw method and a dam method. In the reverse pitch screw method, all of the developers passing through a reverse pitch screw are discharged to the waste toner tank, and in the dam method, when an amount or a load of the developer arrives a predetermined level, the developer is discharged.

However, in the case of the reverse pitch screw method, since all of the developers passing through the reverse pitch screw are discharged, the developer may be sharply discharged due to an increase in an internal pressure of the developing unit or an overage of a new developer, and thus a change amount of the developer in the developing unit may be increased. This has a bad influence on print quality.

Also, in the case of the dam method, all of the developers over the predetermined level are discharged. Here, even when the amount of the developer is the same, a volume thereof is changed according to a ratio between the carrier and the toner. When a ratio of the toner is relatively great, an entire volume thereof is increased, and the level of the developer is increased. Therefore, the developer may overflow and then may be discharged, and thus the amount of the developer is reduced.

SUMMARY OF THE INVENTION

The present invention is directed to a developer discharging device for an image forming apparatus, which is capable of preventing a developer from being sharply discharged, and thus constantly maintaining an amount of the developer.

Also, the present invention is directed to a developer discharging device for an image forming apparatus, which is capable of smoothly discharging the developer without an increase in a size of a developer collecting unit.

According to an aspect of the present invention, there is provided a developer discharging device for an image forming apparatus, which is installed in a developing unit configured to transfer and discharge a developer collected from a drum unit or a newly introduced developer, such that the developer is discharged to a developer collecting unit, including a first discharging part configured to extend from an end of a transferring screw installed in the developing unit, and a second discharging part disposed above the first discharging part in parallel with the first discharging part, wherein the developer discharged from the second discharging part falls into the developer collecting unit.

The first discharging part may include a reverse pitch screw having a pitch formed in an opposite direction to a pitch of the transferring screw, a normal pitch screw disposed at a downstream side of the reverse pitch screw to be adjacent to the reverse pitch screw and having a pitch formed in an opposite direction to the pitch of the reverse pitch screw, and a discharging port formed above the normal pitch screw.

The second discharging part may include a discharging screw configured to extend toward the developer collecting unit, an introducing port in communication with the discharging port, and a shutter installed at an end side of the discharging screw so that the developer falls into the developer collecting unit.

A pressing screw having a pitch formed in an opposite direction to the pitch of the reverse pitch screw and also having a plurality of pressing plates spaced in a circumferential direction may be installed at an upstream side of the reverse pitch screw.

A subsidiary reverse pitch screw having a pitch formed in an opposite direction to the pitch of the normal pitch screw may be installed at a downstream side of the normal pitch screw.

The second discharging part may have a conical case of which a diameter is gradually reduced in a discharging direction of the developer, and the discharging screw may be accommodated in the case so as to have a pitch of which a diameter is gradually reduced in the discharging direction of the developer.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
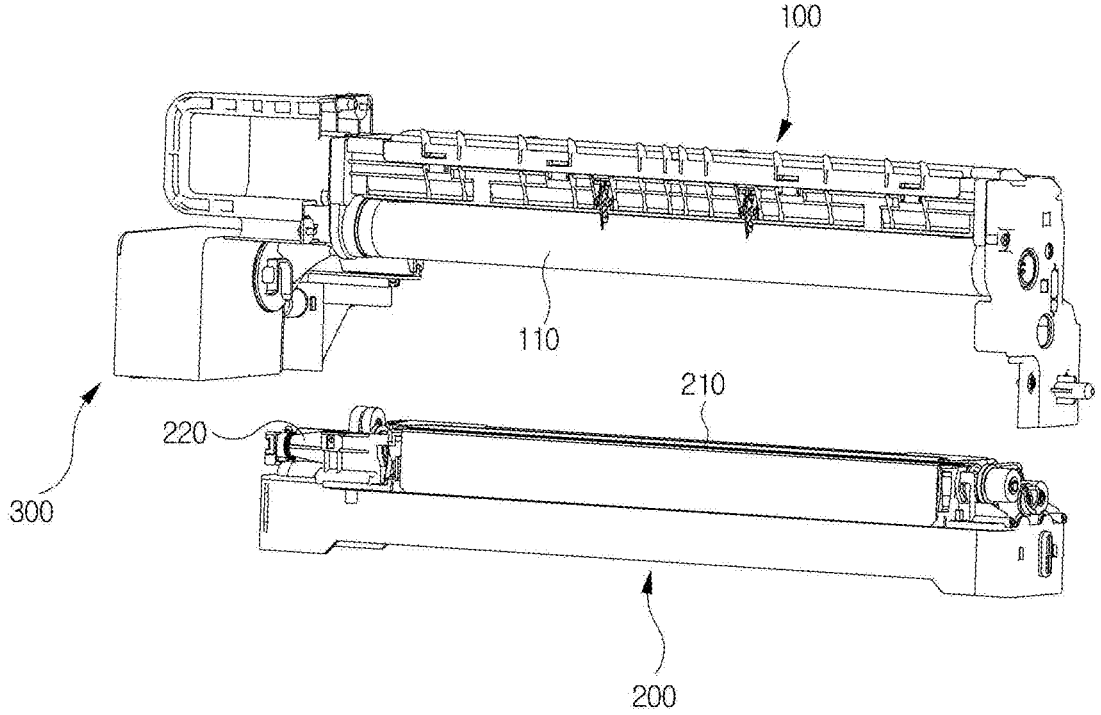
FIG. 1 is an exploded perspective view illustrating a cartridge assembly of an image forming apparatus equipped with a developer discharging device in accordance with the present invention.
Figure 2:
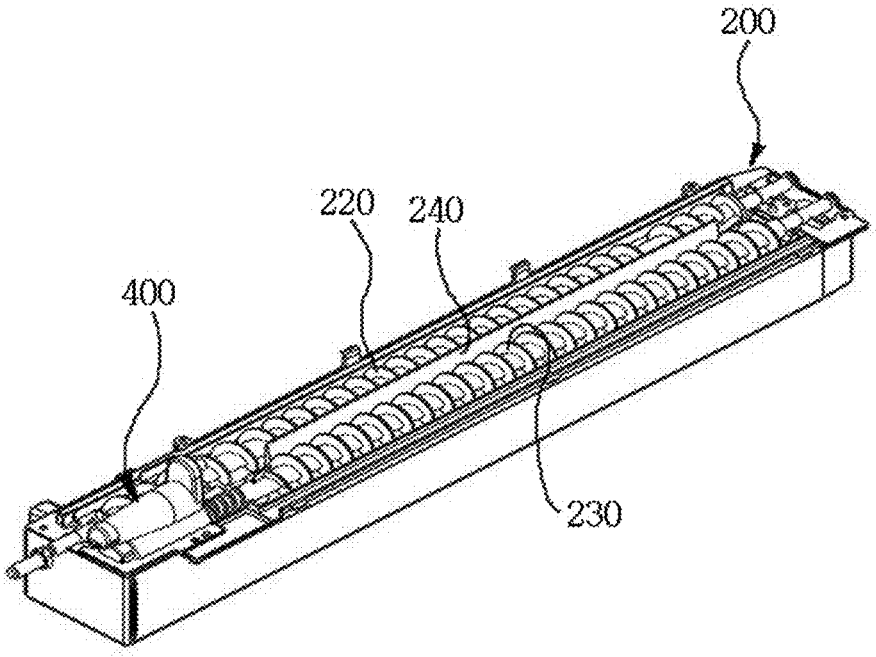
FIG. 2 is a perspective view illustrating a state in which an upper portion of a developing unit for the image forming apparatus in accordance with the present invention is cut away.

Referring to FIGS. 1 and 2, a cartridge assembly equipped with a developer discharging device for an image forming apparatus in accordance with the present invention includes a drum unit 100 and a developing unit 200 which are installed in the image forming apparatus to form an image. A developer collecting unit 300 which collects a developer located in the developing unit 200 is installed at one side of the drum unit 100.

The drum unit 100 includes various components for forming a latent image, such as a photoconductive drum, charging roller and a transfer roller. Also, a water toner transferring route (not shown) is formed in the drum unit 100 to transfer waste toner collected from a surface of the photoconductive drum 110 to one side of the drum unit 100.

The developing unit 200 is provided with a developing roller 210 which supplies the developer to the latent image formed on the photoconductive drum 110, and also coupled with the drum unit 100 so that the developing roller 210 is in contact with the photoconductive drum 110 of the drum unit 100.

Also, the developing unit 200 is configured to receive the developer collected from the drum unit 100 or a newly introduced developer into the developing unit 200. To this end, a first transferring screw 220 and a second transferring screw 230 which extends in parallel with each other in a lengthwise direction thereof are installed in the developing unit 200. A partition 240 is provided between the first transferring screw 220 and the second transferring screw 230, and the developer is moved along the first transferring screw 220 and the second transferring screw 230. Further, the developing unit 200 is provided with a developer discharging device 400 which discharges the developer located therein to the developer collecting unit 300. The developer discharging device 400 will be described later.

The developer collecting unit 300 is provided at one side of the drum unit 100, i.e., one side of the drum unit 100 in a direction that the waste toner is collected to be integrally formed with the drum unit 100. The developer collecting unit 300 serves to collect the developer discharged by the developer discharging device 400 of the developing unit 200.

Referring to FIGS. 2 to 6, the developer discharging device 400 for the image forming apparatus in accordance with the present invention includes a first discharging part 410 and a second discharging part 420 which are installed in the developing unit 200 and also disposed up and down in parallel with each other so as to discharge the developer to the developer collecting unit 300.

The first discharging part 410 extends to an end of the second transferring screw 230, i.e., a downstream side of the second transferring screw 230. And the second discharging part 420 is disposed above the first discharging part 410 in parallel with the first discharging part 410 so that the developer falls into the developer collecting unit 300. Due to a stacking structure of the first and second discharging parts 410 and 420, the developer transferred toward the first discharging part 410 is moved up to the second discharging part 420, and then falls into the developer collecting unit 300 through the second discharging part 420.

Figure 3:
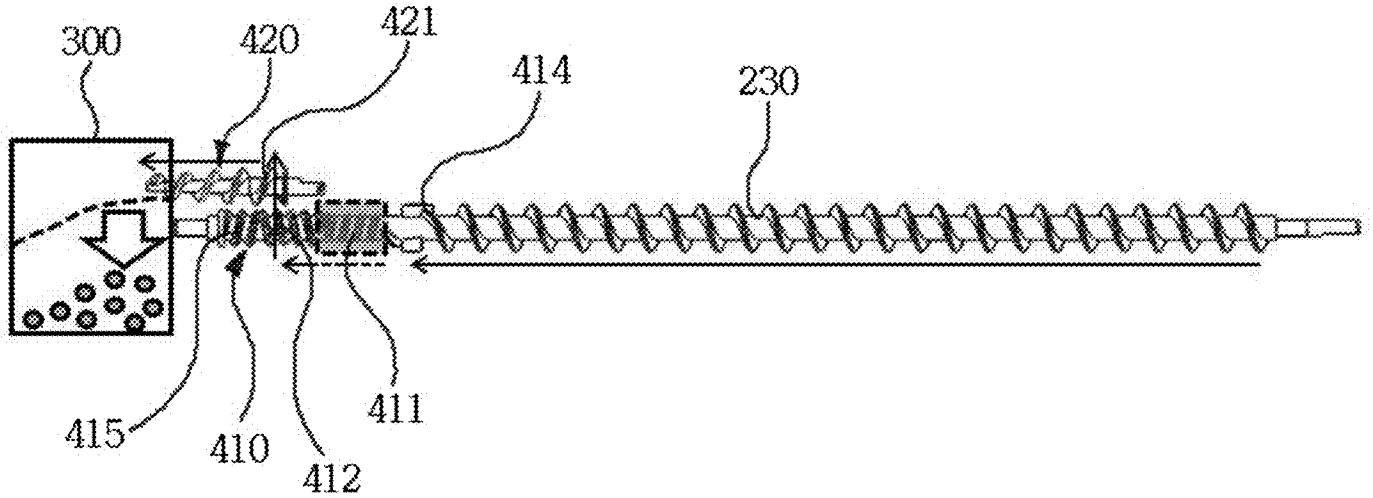
FIG. 3 is a side view schematically illustrating the developing unit and a developer collecting unit of FIG. 2.
Figure 4:
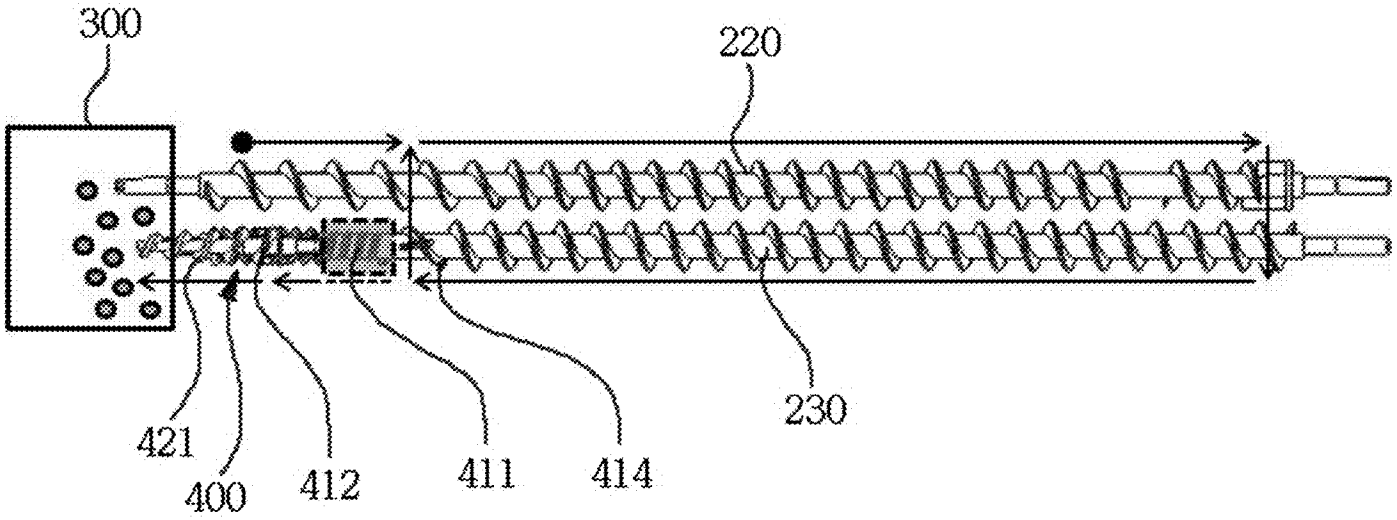
FIG. 4 is a plane view schematically illustrating the developing unit and the developer collecting unit of FIG. 2.
Figure 5:
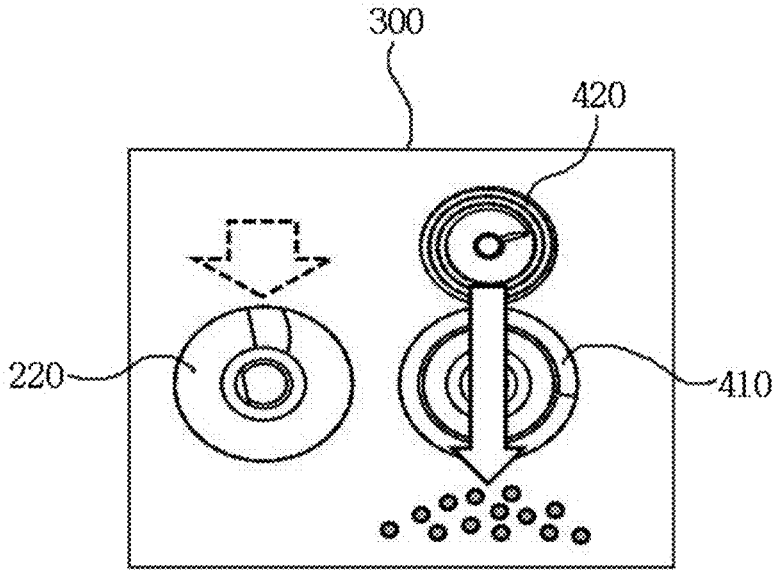
FIG. 5 is a front view schematically illustrating the developing unit and the developer collecting unit of FIG. 2.
Figure 6:
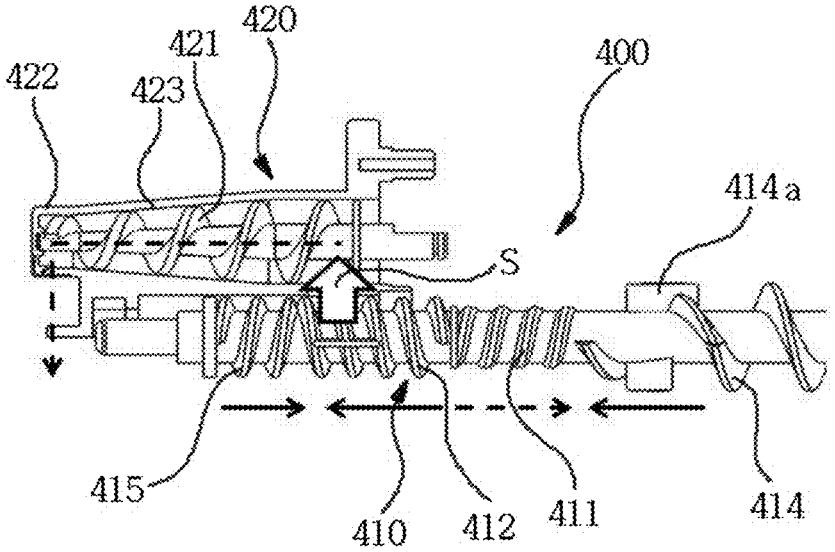
FIG. 6 is a side view illustrating the developer discharging device for the image forming apparatus in accordance with the present invention.

Here, the terms "downstream side" and "upstream side" are based on a developer discharging direction designated by arrows of FIG. 3.

The first discharging part 410 includes a reverse pitch screw 411, a normal pitch screw 412 and a discharging port (not shown). The reverse pitch screw 411 has a pitch (which means a direction and a shape of the screw) formed in an opposite direction to a pitch of the second transferring screw 230, and is disposed at a downstream side of the second transferring screw 230. The normal pitch screw 412 is disposed at a downstream side of the reverse pitch screw 411 to be adjacent to the reverse pitch screw 411 and to have a pitch formed in an opposite direction to a pitch of the reverse pitch screw 411. And the discharging port is formed above the normal pitch screw 412 so that the developer is transferred to the second discharging part 420.

Due to the reverse pitch screw 411, the developer transferred to the downstream side by the second transferring screw 230 is introduced into the first discharging part 410 along the reverse pitch screw 411, only when a predetermined load, i.e., a predetermined amount of the developer exceeds a pressure of the reverse pitch screw 411 by the reverse pitch screw 411 of the first discharging part 410. Also, due to the normal pitch screw 412, the developer introduced into the first discharging part 410 along the reverse pitch screw 411 is further smoothly introduced and moved up toward the discharging port.

The second discharging part 420 includes a discharging screw 421, an introducing port (not shown) and a shutter 422. The discharging screw 421 is disposed above the first discharging part 410 to extend toward the developer collecting unit 300 in parallel with the first discharging part 410, such that the developer is transferred to the developer collecting unit 300. The introducing port is formed to face the discharging port of the first discharging part 410, and the first and second discharging parts 410 and 420 are in communication with each other through the discharging port and the introducing part. A portion of FIG. 6 designated by an arrow S is a communication portion between the discharging port and the introducing port. The shutter 422 is installed at a downstream end of the discharging screw 421, and has an opening which is selectively opened and closed, and thus the developer may falls into the developer collecting unit 300. The shutter 422 is rotatably provided at an end of the second discharging part 420. When the cartridge assembly is installed at the image forming apparatus, the shutter 422 is rotated, and thus the opening is located downward, and a discharging route of the developer is opened. When the cartridge assembly is separated from the image forming apparatus, the shutter 422 is rotated to its original position, and thus the opening is located toward a side surface, and the discharging route of the developer is closed.

Due to the first and second discharging parts 410 and 420, the developer passing through the reverse pitch screw 411 of the first discharging part 410 is moved up to the second discharging part 420, and then discharged through the shutter 422 of the second discharging part 420, and thus the developer is prevented from being sharply discharged. Therefore, a change (a ratio change between the toner and the carrier) in the amount of the developer in the developing unit 200 may be constantly maintained.

Also, the developer moved up to the second discharging part 420 through the first discharging part 410 falls to a lower side through the discharging screw 421 and the shutter 422. Therefore, the developer collecting unit 300 is not needed to extend to a lower side of the first discharging part 410, and thus a size of the developer collecting unit 300 may be reduced.

Preferably, a pressing screw 414 is installed at an upstream side of the reverse pitch screw 411. The pressing screw 414 is installed between the reverse pitch screw 411 and the second transferring screw 230, and has a pitch formed in an opposite direction to the pitch of the reverse pitch screw 411. A plurality of pressing plates 414*a* are provided on an outer circumferential surface of the pressing screw 414 to be spaced in a circumferential direction thereof. The pressing screw 414 applies a predetermined pressure in a reverse pitch direction using the pressing plates 414*a*. Therefore, the developer transferred by the second transferring screw 230 may be transferred toward the reverse pitch screw 411 with a predetermined pressure (load) generated by the pressing screw 414.

Further, a subsidiary reverse pitch screw 415 is installed at a downstream side of the normal pitch screw 412. The subsidiary reverse pitch screw 415 has a pitch formed in an opposite direction to a pitch of the normal pitch screw 412 so as to apply a predetermined pressure toward the reverser pitch screw 411. Therefore, the pressure is applied at both sides of the reverse pitch screw 411 in opposite directions to each other, and the developer on the reverse pitch screw 411 is moved upward. Thus, the developer of the first discharging part 410 may be smoothly introduced into the second discharging part 420.

Meanwhile, the second discharging part 420 includes a conical case 423 of which a diameter is gradually reduced in a discharging direction of the developer. Also, the discharging screw 421 accommodated in the case 423 has a pitch corresponding to a shape of the case 423, of which a diameter is gradually reduced in the discharging direction of the developer. Due to the shapes of the case 423 and the discharging screw 421, the developer discharged from the second discharging part 420 to the developer collecting unit 300 is prevented from being sharply discharged.

According to the present invention, it is possible to prevent the developer from being sharply discharged, and thus to constantly maintain a change in the amount of the developer (a ratio change between the toner and the carrier).

Also, the developer collecting unit is not needed to extend to the lower side of the first discharging part, and thus the size of the developer collecting unit can be reduced.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A developer discharging device for an image forming apparatus, which is installed in a developing unit configured to transfer and discharge a developer collected from a drum unit or a newly introduced developer, such that the developer is discharged to a developer collecting unit, comprising:

a first discharging part configured to extend from an end of a transferring screw installed in the developing unit; and a second discharging part disposed above the first discharging part in parallel with the first discharging part, wherein the developer discharged from the second discharging part falls into the developer collecting unit, wherein the first discharging part comprises a reverse pitch screw having a pitch formed in an opposite direction to a pitch of the transferring screw, a normal pitch screw disposed at a downstream side of the reverse pitch screw to be adjacent to the reverse pitch screw and having a pitch formed in an opposite direction to the pitch of the reverse pitch screw, and a discharging port formed above the normal pitch screw, wherein a pressing screw having a pitch formed in an opposite direction to the pitch of the reverse pitch screw and also having a plurality of pressing plates spaced in a circumferential direction is installed at an upstream side of the reverse pitch screw, wherein a subsidiary reverse pitch screw having a pitch formed in an opposite direction to the pitch of the normal pitch screw is installed at a downstream side of the normal pitch screw.

2. The developer discharging device of claim 1, wherein the second discharging part comprises a discharging screw configured to extend toward the developer collecting unit, an introducing port in communication with the discharging port, and a shutter installed at an end side of the discharging screw so that the developer falls into the developer collecting unit.

3. The developer discharging device of claim 2, wherein the second discharging part has a conical case of which a diameter is gradually reduced in a discharging direction of the developer, and the discharging screw is accommodated in the case so as to have a pitch of which a diameter is gradually reduced in the discharging direction of the developer.

* * * * *